United States Patent [19]

Wright

[11] 4,415,199

[45] Nov. 15, 1983

[54] FOLDING PICNIC TABLE

[75] Inventor: Clem B. Wright, South Fulton, Tenn.

[73] Assignee: Waymatic, Inc., Fulton, Ky.

[21] Appl. No.: 343,747

[22] Filed: Jan. 29, 1982

[51] Int. Cl.[3] ..... A47B 39/00

[52] U.S. Cl. ..... 297/159; 108/115; 297/135

[58] Field of Search ..... 297/159, 157, 158, 135, 297/173, 174; 108/115, 116, 117, 129, 130, 131

[56] References Cited

U.S. PATENT DOCUMENTS

| | | | |
|---|---|---|---|
| 652,720 | 6/1900 | Merriman | 108/115 |
| 769,354 | 9/1904 | Nielsen | 297/159 |
| 942,643 | 12/1909 | Hummer | 108/115 X |
| 2,548,682 | 4/1951 | Price | 297/159 |
| 2,690,210 | 9/1954 | Holick | 297/159 |
| 2,717,631 | 9/1955 | Howe | 297/159 |
| 2,748,837 | 6/1956 | Beller | 297/159 |
| 2,790,688 | 4/1957 | Shepherdson | 108/115 |
| 4,040,658 | 8/1977 | Mayol | 297/159 |
| 4,330,151 | 5/1982 | Healey | 297/157 |

*Primary Examiner*—James T. McCall

*Attorney, Agent, or Firm*—B. P. Fishburne, Jr.

[57] ABSTRACT

A heavy-duty picnic table folds into a compact form for shipment or storage. Two folding end frames which mount a table top and opposite side benches fold in unison when locking pins are removed from two cross braces which maintain the table securely in an erected state. Operational parts are tethered to prevent separation and loss. The table is characterized by strength and stability.

8 Claims, 9 Drawing Figures

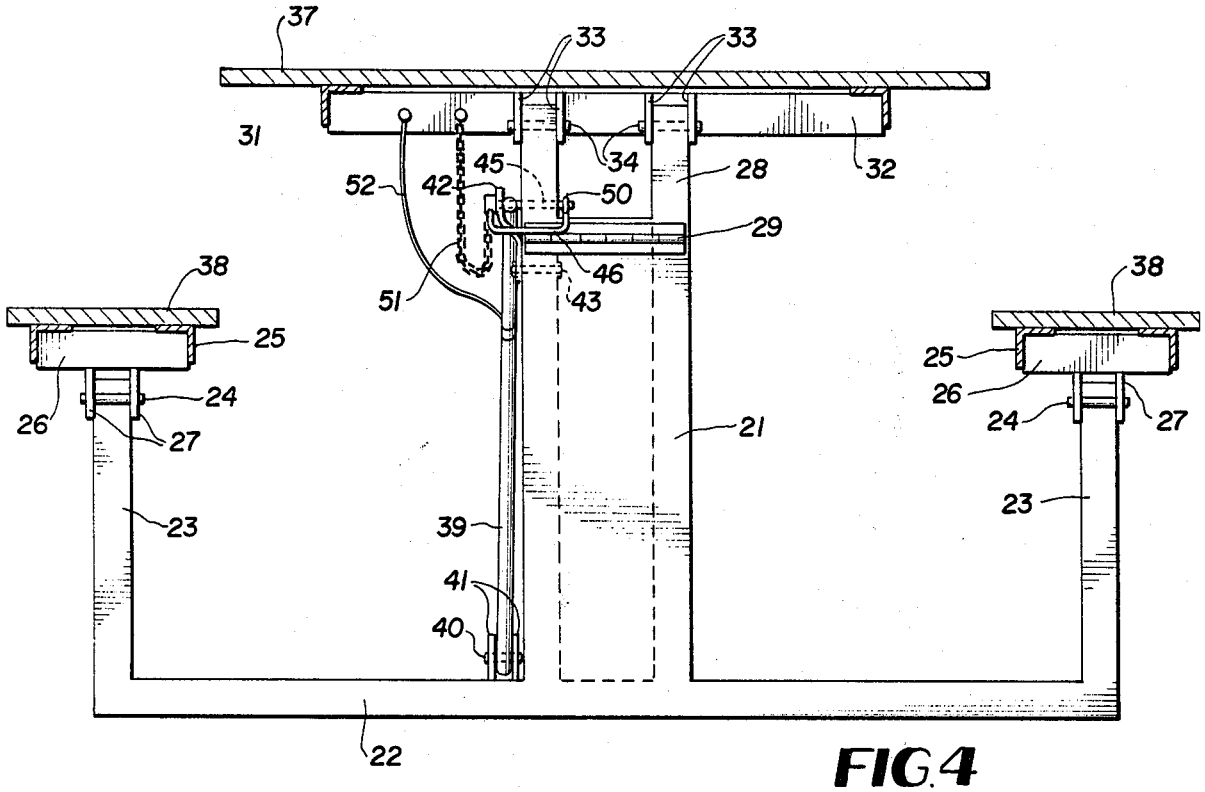
FIG. 4
FIG. 8
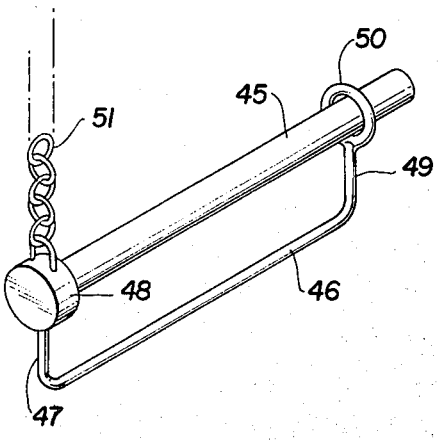
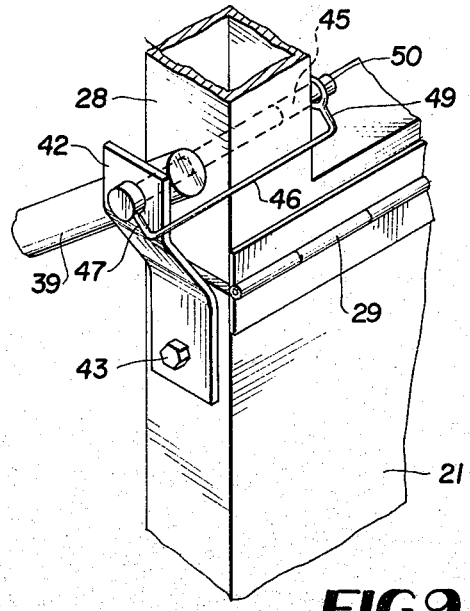
FIG. 9

FOLDING PICNIC TABLE

BACKGROUND OF THE INVENTION

Folding tables of varying configurations are known in the prior art. In most cases, a degree of durability and stability is sacrificed when the table is constructed so that it may be folded or collapsed. Furthermore, in the known prior art, folding tables generally are not adaptable to heavy-duty outdoor usage such as use in public parks or at schools where rough handling is encountered.

With the above drawbacks of the prior art in mind, it is the objective of the present invention to provide a heavy-duty folding picnic table of great durability and strength which has the ability to fold into a very compact state for shipment or storage without sacrificing any of its stability and strength.

A further object of the invention is to provide a folding table which is convenient to erect and fold without the use of tools, and in which a minimum number of operational components employed in the erection and folding processes are tethered to avoid separation and loss. The table is held with stability and strength in the erected use position by two cross braces and two associated locking pins which are easily manipulated without tools. Two ends frames supporting the table top and two parallel benches fold in unison when the locking pins are separated from the cross braces and end frames.

Other features and advantages of the invention will be apparent to those skilled in the art during the course of the following description.

BRIEF DESCRIPTION OF THE DRAWINGS

FIG. 4 is a vertical section taken on line 4—4 of FIG. 2.

FIG. 8 is a perspective view of a locking pin assembly.

FIG. 9 is a fragmentary perspective view of one end frame, and associated brace, and the locking pin arrangement.

DETAILED DESCRIPTION

Figures 1, 2, 3:
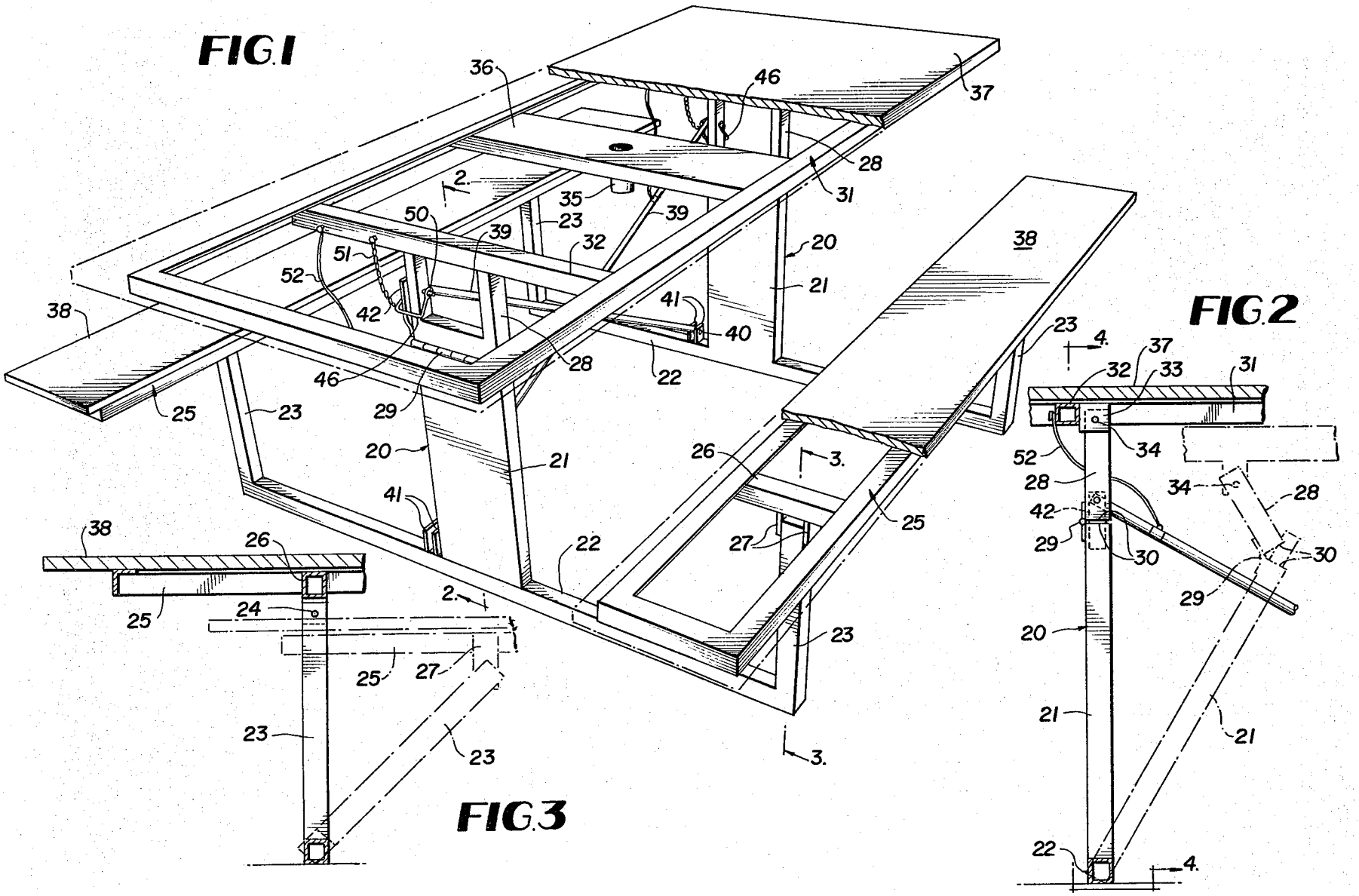
FIG. 1 is a perspective view with parts broken away of a folding picnic table according to the invention.
FIG. 2 is a fragmentary vertical section taken on line 2—2 of FIG. 1.
FIG. 3 is a similar section taken on line 3—3 of FIG. 1.
Figure 5:
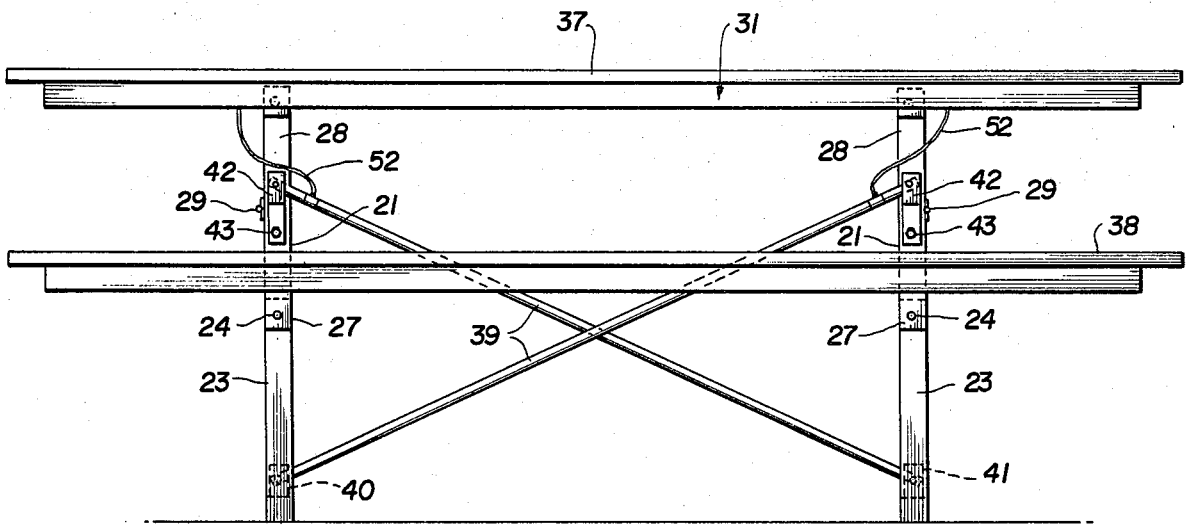
FIG. 5 is a side elevation of the table in its erected state.

Referring to the drawings in detail, wherein like numerals designate like parts, a folding picnic table is shown comprising two end frames 20 each having a center pedestal 21 joined at its bottom to a horizontal cross bar 22, projecting equidistantly on opposite sides thereof. The opposite ends of the horizontal cross bars 22 carry comparatively shorter rigid upright bars 23, whose top ends are pivotly attached at 24 to parallel horizontal bench frames 25 which extend along the opposite sides of the picnic table when the latter is erected for use. The bench frames 25 include cross members 26, carrying depending lugs 27 which receive the pivot elements connecting the uprights 23 with the bench frames 25.

The pedestals 21 include upper U-shaped extensions 28 hinged thereto on their outer sides by transverse horizontal axis hinges 29. As shown in the drawings, the pedestals break or collapse inwardly toward each other when the table is folded. The opposing end faces 30 of the pedestal sections prevent them from folding outwardly or away from each other.

A rigid rectangular table top frame 31 is provided, having the same length as the two bench frames 25 but being considerably wider than the bench frames. The table top frame 31 is equipped near and inwardly of its opposite ends with fixed cross bars 32 having pairs of spaced lugs 33 welded to the interior sides thereof, which lugs are pivotly connected at 34 to the upper extensions 28 of the folding pedestals.

Optionally, the table top frame 31 may be equipped with a vertical axis sleeve 35, adapted to receive an umbrella shaft, not shown. The sleeve when employed is secured to another cross member 36 of the table top frame. The covering, or decking, 37 and 38 for the table top and benches may vary in nature. For example, it may be metal, tough plastics material or wood. For home patio purposes the use of wood is preferable, while for outdoor usage in parks or recreation areas and commercial usage by concessionaires metal or plastics may be preferrable. The covering or decking 37 and 38 is anchored to frames 31 and 25 in any conventional manner.

The picnic table in its fully extended use form is secured firmly by a single pair of cross braces 39, whose lower ends are permanently attached at 40 to upstanding lugs 41 fixed to the cross bars 22 close to corresponding sides of the pedestals 21. As best shown in FIG. 4 this arrangement locates the braces 39 beneath the table top and well inwardly from its opposite longitudinal edges and distant from the nearest bench 38 so as not to interfere with the legs or feet of persons seated at the table.

The upper ends of brace bars 39 are adapted to engage between the adjacent sides of the pedestals 21 and anchor brackets 42 which are provided on corresponding side edges of the pedestals 21. The lower ends of the brackets 42 are secured by attaching means 43 while their top ends are offset outwardly from the pedestal extensions 28, as shown.

The top end portions of brace bars 39 have cross apertures 44 and when such upper ends are placed between the brackets 42 and pedestals, releasable locking pins 45 may be placed through the brace bar apertures and through aligned apertures in the offset portions of brackets 42 and pedestal extensions 28. The removable locking pins for brace bars 39 are equipped with retainer springs 46. One arm 47 of each retainer spring is anchored to the head 48 of the pin 45 and its other arm 49 which may be flexed, carries an eye terminal 50 which can receive the interior end of locking pin 45 to retain it in the locking position.

To prevent loss of the locking pins each pin is tethered by a chain 51 to the cross member 32 of table top frame 31. Similarly, each brace bar 39 is tethered near its upper end by a cable 52 also attached to member 32. When the brace bars 39 are released from the pedestals in the folding of the picnic table, FIG. 6, the cables 52 will support the bars 39 so that they will not fall abruptly.

Figure 6:
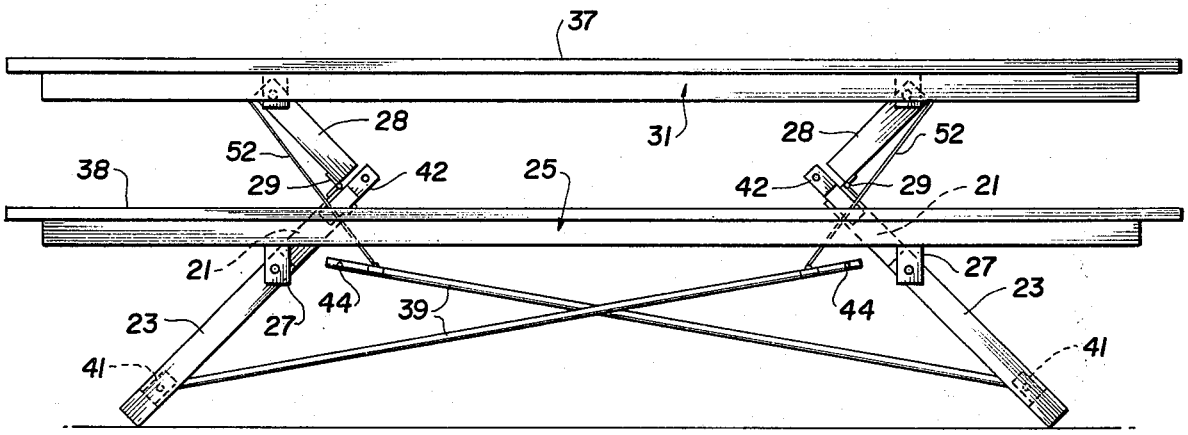
FIG. 6 is a similar view of the table partly folded.
Figure 7:
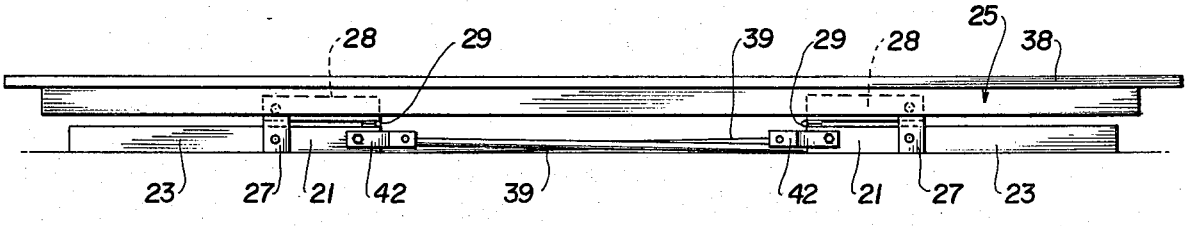
FIG. 7 is a similar view of the table completely folded.

Following removal of the two locking pins 45 from their locking positions, the picnic table collapses or folds in the manner shown in FIGS. 6 and 7 to a flat, compact condition where it is only about 4 inches thick. This is highly advantageous for shipment and storage.

To erect the table, it is merely necessary to lift the table top to the normal use position which causes unfolding of the two pedestals. As this occurs, the crossing brace bars 39 are lifted substantially by the cables 52 and their upper apertured ends are placed manually between the brackets 42 and extended pedestals and locked by placement of the two locking pins 45 as previously described.

The construction is extremely simple and convenient to use. It is sturdy and durable and can withstand heavy usage. It is relatively inexpensive to manufacture. Most importantly, the folding feature is achieved without lessening the stability and durability of the table and this has not been the case in the prior art.

Finally, it may be observed that the bench supporting uprights 23 are in common planes with the pedestals 21 and swing in unison therewith as the table is folded. When the table is completely collapsed, FIG. 7, the table top and two benches lie substantially in a common plane, whereas when the table is extended for use its top is well above the level of the two benches.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A folding picnic table comprising a pair of spaced parallel end frames each having a pedestal formed in two hinged sections adapted to fold inwardly toward each other and also adapted to assume extended positions with the hinged sections of the pedestals in end-to-end relationship, a table top frame pivotly attached to the upper hinged section of each folding pedestal, uprights on said end frames lying substantially in the planes occupied by the lower hinged sections of the pedestals, bench frames pivotly attached to the tops of the uprights and lying in planes which are parallel to the plane occupied by the table top frame, a single pair of cross braces having corresponding ends permanently, pivotly attached to said end frames and having opposite corresponding ends adapted for releasable attachment to the pedestals when their hinged sections are extended, and releasable locking pins for said opposite corresponding ends of the braces when they are engaged with the extended pedestals to lock the picnic table in an extended use position, said locking pins passing through locking openings in the braces and registering locking openings in the pedestals.

2. A folding picnic table as defined in claim 1, and locking brackets fixed to one hinged section of each folding pedestal and being spaced from corresponding sides of the other hinged section of each pedestal, said opposite corresponding ends of the braces engaging between said brackets and said pedestals, and said locking pins engaging said brackets.

3. A folding picnic table as defined in claim 2, and flexible tether elements connecting the locking pins with said table top frame.

4. A folding picnic table as defined in claim 3, and additional tether elements connecting said braces near their free ends with said table top frames whereby the braces are supported by the last named tether elements during table folding and unfolding operations.

5. A folding picnic table as defined in claim 2, and spring retainer elements carried by the locking pins and adapted to engage the locking pins to retain them in their locking positions with respect to the pedestals and locking brackets.

6. A folding picnic table comprising a pair of spaced parallel end frames each having a central pedestal formed in two folding hinged sections and each having a pair of uprights on opposite sides of the central pedestals and being spaced substantially equidistantly therefrom, opposite side bench frames pivotly attached to the tops of said uprights, a table top frame pivotly attached to the tops of said pedestals, a pair of cross braces having lower ends pivotly attached to the end frame near corresponding sides of the pedestals and substantially inwardly of the bench frames, and releasable means attaching upper ends of the cross braces to said pedestals to lock the pedestals in extended use positions with the table top frame disposed above the bench frames in a plane parallel to a common plane occupied by the bench frames.

7. A folding picnic table as defined in claim 6, and each end frame including a bottom bar interconnecting the lower ends of the pedestals and uprights.

8. A folding picnic table as defined in claim 7, and each folding pedestal including a hinged joint between said hinged sections more distant from said bottom bar than from said table top frame, said pedestals being adapted to fold inwardly with the hinged joints thereof moving toward each other while the bottom bars of the end frame move away from each other.

* * * * *